US008683723B2

(12) United States Patent
Sjödin et al.

(10) Patent No.: US 8,683,723 B2
(45) Date of Patent: Apr. 1, 2014

(54) ESL LOCKING MECHANISM

(75) Inventors: Håkan Sjödin, Knivsta (SE); Nils Hulth, Uppsala (SE); Pär Rosander, Uppsala (SE)

(73) Assignee: Pricer AB, Stockholm (SE)

( * ) Notice: Subject to any disclaimer, the term of this patent is extended or adjusted under 35 U.S.C. 154(b) by 177 days.

(21) Appl. No.: 13/257,534

(22) PCT Filed: Mar. 9, 2010

(86) PCT No.: PCT/SE2010/050259
§ 371 (c)(1),
(2), (4) Date: Sep. 19, 2011

(87) PCT Pub. No.: WO2010/107367
PCT Pub. Date: Sep. 23, 2010

(65) Prior Publication Data

US 2012/0060399 A1 Mar. 15, 2012

(30) Foreign Application Priority Data

Mar. 20, 2009 (SE) ..... 0950179

(51) Int. Cl.
*G09F 3/18* (2006.01)

(52) U.S. Cl.
USPC ..... 40/655; 40/661.01; 40/661.03; 340/5.91

(58) Field of Classification Search
USPC ..... 40/655, 661.01, 661.03, 642.02; 340/5.91
See application file for complete search history.

(56) References Cited

U.S. PATENT DOCUMENTS 5,473,832 A * 12/1995 Briechle et al. ..... 40/124.05
5,553,412 A * 9/1996 Briechle et al. ..... 40/124.01
(Continued)

FOREIGN PATENT DOCUMENTS

CN 1260897 A 7/2000
FR 2 853 440 A1 10/2004
(Continued)

OTHER PUBLICATIONS

International Search Report for International Application No. PCT/SE2010/050259 mailed Jun. 15, 2010.
(Continued)

*Primary Examiner* — Gary Hoge
(74) *Attorney, Agent, or Firm* — Jones Day

(57) ABSTRACT

An ESL and ESL holder combination includes a locking mechanism for releasably securing the ESL to the ESL holder and an ESL provided with at least one gripping means for cooperative engagement with the ESL holder. A protruding, spring loaded locking element is arranged on the ESL for cooperative engagement with the shelf edge rail. The ESL holder is attachable to the edge of a shelf, the ESL holder being provided with one or more receiving means such as slots for receiving the gripping means and the locking element in cooperative engagement. The spring loaded locking element arranged adjacent to the gripping means and positioned on the ESL such that the spring loaded locking element cannot enter the receiving means on the ESL holder during insertion of the gripping means into the receiving means, and such that it enters the receiving means by spring action when the gripping means is brought into a hooked position, in the receiving means. The spring loaded locking element prevents removal of the ESL from the ESL holder, unless the spring loaded locking element is retracted from its receiving means, and allows for the gripping means to leave its hooked position.

16 Claims, 7 Drawing Sheets

(56) References Cited

U.S. PATENT DOCUMENTS

| | | | | |
|---|---|---|---|---|
| 5,775,017 | A * | 7/1998 | Morrow | 40/642.01 |
| 6,069,596 | A * | 5/2000 | Marvin et al. | 345/52 |
| 6,189,248 | B1 * | 2/2001 | Nagel et al. | 40/661.03 |
| 6,418,651 | B1 | 7/2002 | Joliey | |
| 6,698,701 | B1 * | 3/2004 | Dalton | 248/222.12 |
| 7,287,350 | B2 * | 10/2007 | Fast et al. | 40/642.02 |
| 7,900,387 | B2 * | 3/2011 | Lee et al. | 40/661.03 |
| 2003/0111580 | A1 * | 6/2003 | Catteau et al. | 248/222.51 |
| 2004/0262470 | A1 * | 12/2004 | Lowry et al. | 248/205.1 |
| 2009/0178314 | A1 * | 7/2009 | Nguyen | 40/446 |
| 2010/0031548 | A1 * | 2/2010 | Lee et al. | 40/655 |

FOREIGN PATENT DOCUMENTS

| | | | |
|---|---|---|---|
| FR | 2857143 | A1 | 1/2005 |
| GB | 2 249 854 | A | 5/1992 |
| WO | WO 97/48862 | A1 | 12/1997 |

OTHER PUBLICATIONS

Written Opinion of the International Searching Authority for International Application No. PCT/SE2010/050259 completed on Jun. 14, 2010 (mailed Jun. 15, 2010).

"MEMO Concerning the Official Action Reported in the Covering Letter" (Office Action) issued in corresponding Mexican Patent Application No. MX/a/2011/009264, Jul. 25, 2013.

First Office Action for Chinese Patent Application No. 201080012700.2 (Date of Issue: Jul. 11, 2013).

* cited by examiner

ESL LOCKING MECHANISM

CROSS REFERENCE TO RELATED APPLICATIONS

This application is a national stage application of International Application No. PCT/SE2010/050259, filed on Mar. 9, 2010, which claims the benefit of Swedish Patent Application No. 0950179-2, filed on Mar. 20, 2009, the entire contents of both applications are incorporated herein by reference.

TECHNICAL FIELD OF THE INVENTION

The embodiments of the present invention relate to an electronic shelf label (ESL) and shelf edge rail combination. In particular, the embodiments of the present invention relate to such a combination comprising a locking mechanism for locking the ESL to the shelf rail edge.

BACKGROUND OF THE INVENTION

Electronic labeling systems are used all over the world, in particular in large facilities, for displaying information like price and the like for services and items available for customers.

Some known electronic labeling systems comprise an Electronic Shelf Label (ESL) and a shelf edge rail. The shelf edge rail is often permanently mounted onto the shelf, and then the ESL is attached to the shelf edge rail. A problem with most systems available today is that the ESL can be easily removed from the shelf edge rail by anyone, whereas it is desired that the ESL is easy to remove from the shelf edge rail only by a person authorized to do so to avoid the loss of ESLs by theft or vandalism.

SUMMARY OF THE INVENTION

The object of the embodiments of the present invention is to overcome at least some of the drawbacks of the prior art. This object is achieved, for example, by a combination of the ESL and ESL holder as defined in claim 1.

According to the embodiments of the present invention an Electronic Shelf Label (ESL) and ESL holder combination comprises a locking mechanism for releasably securing the ESL to the ESL holder, and an ESL provided with at least one gripping means for cooperative engagement with the ESL holder. A spring loaded locking element, movable between a first protruding position and a second retracted position, is arranged on the ESL for cooperative engagement with the shelf edge rail. The ESL holder is attachable to the edge of a shelf, the ESL holder being provided with one or more receiving means such as slots for receiving the gripping means and the spring loaded locking element in cooperative engagement. The spring loaded locking element is arranged on the ESL such that the spring loaded locking element cannot enter the receiving means on the ESL holder during insertion of the gripping means into the receiving means, and such that it enters the receiving means by spring action when the gripping means is brought into a hooked position, in the receiving means. Thereby, the spring loaded locking element prevents removal of the ESL from the ESL holder unless the spring loaded locking element is retracted from its receiving means and allows for the gripping means to leave its hooked position.

The embodiments of the present invention are intended to overcome problems related to loss of ESLs due to theft or vandalism.

It is another object of the embodiments of the present invention to provide an ESL which is securely attached to the shelf edge rail, while being very easy to remove provided that a specific and correct tool is used.

It is another object of the embodiments of the present invention to enable locking of the ESL to a specific position on the shelf edge rail, and avoid the ESL being slid sideways to a new position by someone not authorized to do so.

It is yet another object of the embodiments of the present invention to provide a shelf edge rail which does not collect dust and other unwanted particles in the receiving section on the parts of the shelf rail edge that are not in use, i.e., occupied by ESL units.

Embodiments of the present invention are defined in the dependent claims. Other objects, advantages, and novel features of the invention will become apparent from the following detailed description of examples of embodiments of the present invention when considered in conjunction with the accompanying drawings and claims.

BRIEF DESCRIPTION OF THE DRAWINGS

Preferred embodiments of the present invention will now be described with reference to the accompanying drawings, wherein.

DETAILED DESCRIPTION OF EMBODIMENTS OF THE PRESENT INVENTION

For the purpose of the present invention, the term electronic shelf label (ESL) 100 means an electronic label with a display used to display price, information, or promotional messages, and also dynamically update or change the message. The label is typically used on shelf edges, peg hooks, bins, hangers, and other places in retail stores.

Figure 1A:
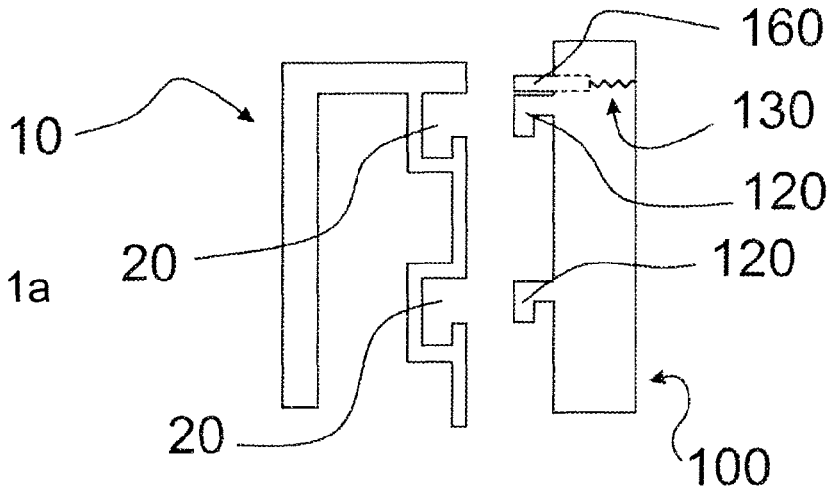
FIG. 1*a* illustrates an ESL and a shelf edge rail separated from each other.

In an embodiment of the present invention, illustrated in FIG. 1, an ESL 100 and ESL holder 10 combination comprises a locking mechanism for releasably securing the ESL 100 to the ESL holder 10 and an ESL 100 provided with at least one gripping means 120 for cooperative engagement with the ESL holder 10. A spring loaded locking element 160, movable between a protruded position and a retracted position, is arranged on the ESL 100 for cooperative engagement with the shelf edge rail. The ESL holder 10 is attachable to the edge of a shelf, where the ESL holder 10 is provided with one or more receiving means 20 such as slots for receiving the gripping means 120 and the locking element 160 in cooperative engagement. The spring loaded locking element 160 is arranged and positioned on the ESL 100 such that the spring loaded locking element 160 cannot enter the receiving means 20 on the ESL holder 10 during insertion of the gripping means 120 into the receiving means 20, and such that it enters the receiving means 20 by a spring action when the gripping means 120 is brought into a hooked position in the receiving means 20. Thereby, the spring loaded locking element 160 prevents removal of the ESL 100 from the ESL holder 10 unless the spring loaded locking element 160 is retracted from its receiving means 20 and allows for the gripping means 120 to leave its hooked position. In this way, the locking mechanism can be placed in an unlocked position and a locked position, respectively.

The ESL holder can be a shelf edge rail 10, a free-standing holder 400, a plate holder 410, or any other holder adapted to receive an ESL 100 according to the embodiments of the present invention.

Figure 3A:
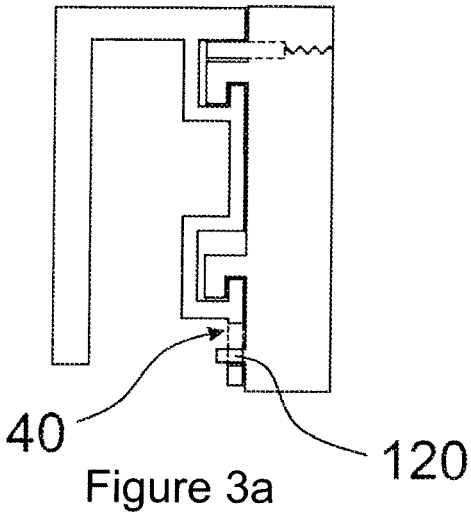
FIG. 3*a* illustrates the ESL locked to the shelf edge rail with a positioning element and its mating slot in one position.
Figure 3B:
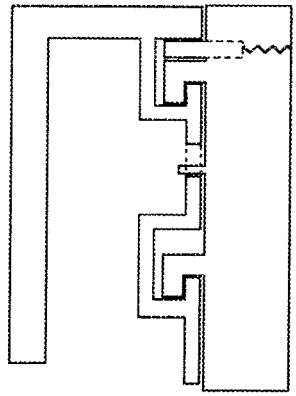
FIGS. 3*b*-3*c* illustrate the ESL locked to the shelf edge rail with a positioning element and its mating slot in another position.
Figure 3C:
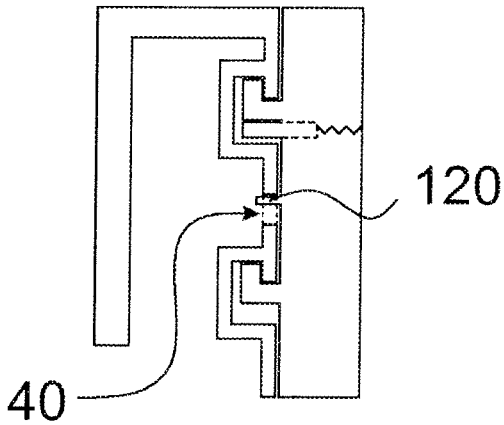

During insertion of the gripping means 120 into its mating receiving means 20, the spring loaded locking element 160 is pushed into the ESL 100 and finally reaches a state where it is substantially completely retracted inside the ESL 100, counteracting and loading the spring. When the gripping means 120 has reached an end position in the receiving means 20, and is brought into a hooked position in the receiving means 20 by sliding it down into the recess (or up as in the embodiment of FIG. 3*c*), the spring loaded locking element 160 is released from its inserted state, and enters the receiving means 20 by spring action. Thereby, the spring loaded locking element 160 prevents removal of the ESL 100 from the shelf edge rail 10 unless the spring loaded locking element 160 is retracted from the receiving means 20 and thereby allows for the gripping means 120 to leave its hooked position.

The gripping means 120 provided on the ESL 100 for cooperative engagement with the receiving means 20 on the shelf edge rail 10 is preferably substantially hook-shaped for grasping the receiving means 20 on the shelf edge rail 10. The gripping means 120 may have an "L"-shape, a rounded hook-shape, or any other hook-like shape suitable for securely grasping a receiving means 20. The spring loaded locking element 160 arranged on the ESL 100 will, together with the gripping means 120, interact with the receiving means 20 on the shelf edge rail 10 while the gripping means 120 (due to its hook-shaped cross-section) can be adapted to hook on to the receiving means 20 on the shelf edge rail 10.

The gripping means 120 on the ESL 100 may be extended along the entire backside of the ESL 100 forming a ledge or rim like structure, or it may cover only one section or a plurality of sections. The hook-shaped gripping means 120 may be arranged to hook onto the receiving means 20 such that the gripping means 120 mates with the receiving means 20.

In a preferred embodiment of the present invention, in addition to the locking mechanism, the ESL 100 also comprises a positioning element 140. The positioning element 140 can be arranged anywhere on an ESL 100 surface, such that during attachment to an ESL holder 10, 400, 410, it abuts the ESL holder 10, 400, 410, wherein a mating surface of the ESL holder 10, 400, 410 comprises a positioning element slot 40. The positioning element 140 secures the ESL 100 sideways with respect to the ESL holder 10, 400, 410, thereby forcing the ESL 100 into a fixed position onto the ESL holder 10, 400, 410. The positioning element 140 can be a pin placed somewhere on the mating surface of the ESL 100. The positioning element slot 40 is placed somewhere on the mating surface of the ESL holder 10, 400, 410. The positioning element 140 and the positioning element slot 40 are arranged at their respective mating surface such that they mate when the ESL 100 is assembled onto the ESL holder 10, 400, 410, and different positions of the positioning element 140 and the positioning element slot are illustrated in FIGS. 3-5 and 7-8. It is also possible to place the positioning element 140 on the ESL holder 10, 400, 410, and the positioning element slot 40 somewhere in the mating surface of the ESL 100, as long as the positioning element 140 and the positioning element slot 40 are adapted to mate when mounting the ESL 100 to the ESL holder 10, 400, 410. The spring loaded locking element 160 and the positioning element 140 may also be the same element.

Figure 1B:
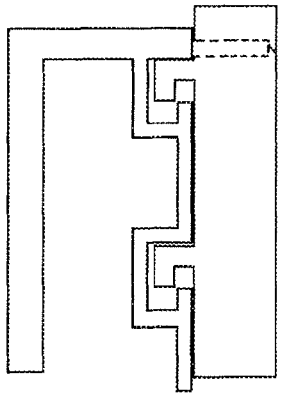
FIG. 1*b* illustrates the ESL when a gripping element is inserted into a mating recess on the shelf edge rail, and brought to an inner position.
Figure 2A:
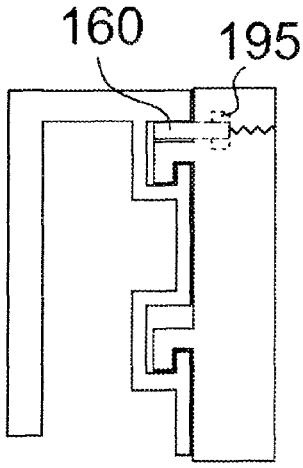
FIG. 2*a* illustrates the ESL in a locked position.
Figure 2B:
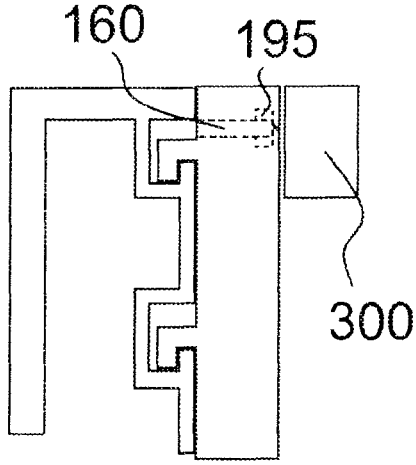
FIG. 2*b* illustrates the ESL in a position where a retractable spring loaded element is retracted back into its recess within the ESL, so that the ESL may be removed from the shelf edge rail.

The spring loaded locking element 160 is suitably arranged on the ESL 100 such that it abuts the shelf edge rail 10 and will be forced inwards into a mating recess of the ESL 100 during the action when the gripping element 120 is inserted into the mating recess on the rail and brought to an inner position illustrated in FIG. 1*b*. Subsequently, when the gripping element 120 is brought to a hooked position in the receiving means 20, the spring loaded locking element 160 snaps into the receiving means 20 by a spring action, thus securely locking the ESL 100 to the shelf edge rail 10 until the spring loaded locking element 160 is forced back into the recess of the ESL 100. FIG. 2*a* shows the locking mechanism with the spring loaded locking element 160 in a locked position. FIG. 2*b* shows a position where the spring loaded locking element 160 is forced back into the recess of the ESL 100, enabling the removal of the ESL 100 from the shelf edge rail 10.

In order to enable retracting the spring loaded locking element 160, magnetic means are provided. Namely, according to the embodiments of the present invention, the spring loaded locking element 160 is magnetic, or the locking mechanism comprises a magnetic element 195 which is attached to the spring loaded locking element 160. The magnetic element 195 may be a ferromagnetic element. The magnetic element 195 is mounted onto the spring loaded locking element 160 such that it can be affected by an external magnet 300. By letting the magnetic field from the external magnet 300 act on the magnetic element 195 in the locking mechanism, the locking element 160 is moved from its locked position to its unlocked position, thereby releasing the ESL 100 from the shelf edge rail 10, which is illustrated in FIG. 2*b* where the magnet 300 attracts the magnetic element 195 on the spring loaded locking element 160.

Normally, the external magnet 300 and the magnetic element 195 has a north and a south pole, and different poles attract each other whereas like poles repel each other. Thus, as the external magnet 300 is placed adjacent to the ESL 100 as shown in FIG. 2*b*, it attracts the magnetic element 195 attached to the spring loaded locking element 160, and retracts it from the recess by magnetic forces. In this embodiment, the spring loaded locking element 160 can be displaced outwards and retracted inwards in a direction substantially perpendicular to abutting surfaces of the ESL 100 and the shelf rail edge 10, and the spring loaded locking element 160 is moved to an unlocked position as it is attracted towards the external magnet 300.

It is also possible to use the repelling force of the magnet as a mechanism to unlock the locking mechanism by placing a magnetic element comprising a north and a south pole onto the spring loaded locking element 160 and orienting it such that the repelling force from the external magnet pushes the locking element 160 back into its recess, allowing for the gripping means to exit its hooked position and subsequently remove the ESL 100 from the ESL holder.

It is also within the scope of the embodiments of the present invention to provide a mechanical solution to move the spring loaded locking element 160 from a locked position to an unlocked position. This can be done in many ways. One way is to arrange a hole in the ESL 100 adapted to receive a key or a tool, and by rotation, or through pressure, from outside ESL 100, move the spring loaded locking element 160 from its locked position to its unlocked position.

Figure 4A:
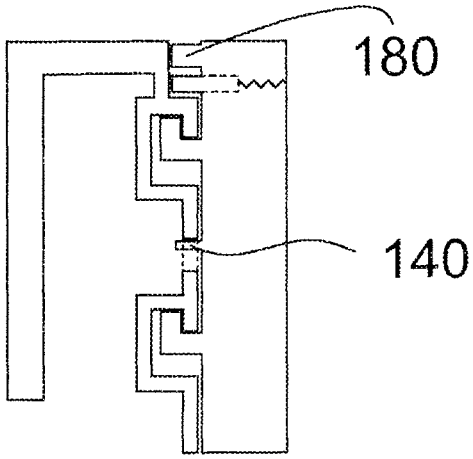
FIG. 4 illustrates embodiments of the present invention wherein the retractable spring loaded element locks the ESL to the shelf edge rail in a separate recess.
Figure 4B:
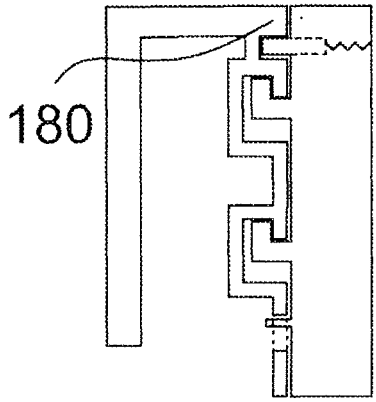
Figure 4C:
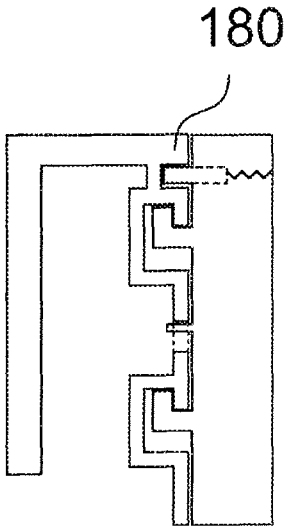

In another embodiment of the present invention, the spring loaded locking element 160 enters a dedicated recess and not the receiving means 20 adapted to receive the gripping means 120. The dedicated recess can be formed and integrated within the shelf edge rail 10 as shown in FIGS. 4*b*-4*c*, or it can be formed by the cooperative engagement between the shelf edge rail 10 and a protecting element 180 on the ESL 100 as shown in FIG. 4*a*.

Figure 9A:
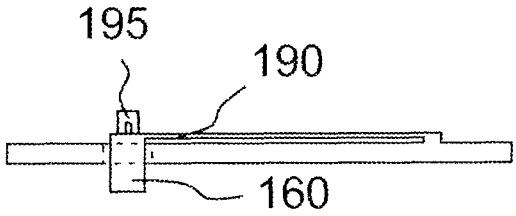
FIG. 9*a* illustrates a side view of a tongue element attached to a locking mechanism.
Figure 9B:
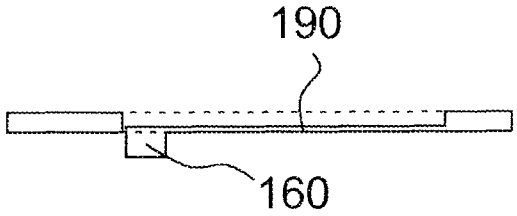
FIG. 9*b* illustrates a side view of a tongue element integrated in a locking mechanism.
Figure 9C:
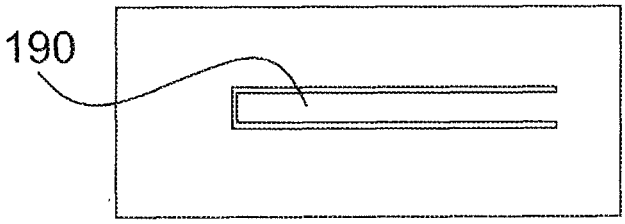
FIG. 9*c* illustrates a top view of a tongue element integrated in a locking mechanism.
Figure 9D:
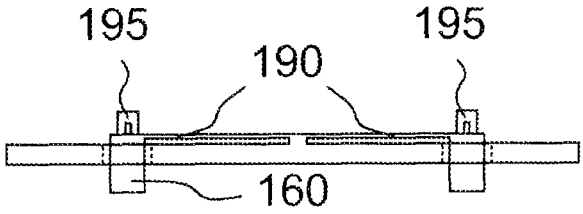
FIG. 9*d* illustrates a tongue element that has two movable ends.
Figure 9E:
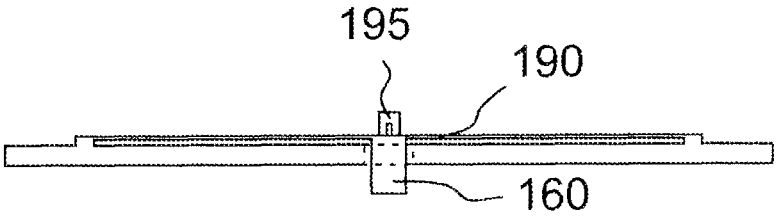
FIG. 9*e* illustrates a tongue element attached to the locking mechanism at two positions and that has a flexible mid section.

In an embodiment of the present invention, the spring loaded locking element 160 comprises a resilient element 130, 190 attached to the ESL 100 and having at least one movable section, as illustrated in FIGS. 9*a*-9*e*. A magnetic element 195 may be mounted on the movable section. The resilient element 130, 190 may be a resilient tongue element 190 having one free movable end or free movable section, and being attached to the ESL 100 in one end. The resilient tongue element 190 may also be attached to the ESL 100 in both ends, having a flexible and movable mid-section as illustrated in FIG. 9*e*. The resilient tongue element 190 may also be attached to the ESL 100 in the mid-section of the tongue so as to exhibit at least two flexible and movable ends, as illustrated in FIG. 9*d*. The magnetic element 195 will then be placed on the flexible and movable section(s) of the resilient tongue element 190.

In another embodiment of the present invention, the retractable and spring loaded locking element 160 is directly affected by the movement of the magnetic element 195 attached to the movable section of the resilient element 130. When the magnetic element 195 is exposed to a magnetic field, it moves the locking element 160 together with the movable section of the resilient element 130, from a locked position to an unlocked position, enabling removal of the ESL 100 from the shelf edge rail 10. The locking mechanism can be mounted onto the ESL 100 or integrated in the ESL 100. In addition, parts of the locking mechanism may be integrated in the ESL 100, and other parts may be assembled onto/in the locking mechanism.

In an embodiment of the present invention, the shelf edge rail 10 comprises at least one receiving element 20 adapted to receive the protruding element of the locking mechanism and/or the ESL 100 (the latter combination is referred to herein as the ESL 100). The receiving means 20 may be a recess adapted to receive the protruding element of the ESL 100. The recess may, in a cross-sectional view, be "L"-shaped, have a rounded hook-shape, or any other hook-like shape suitable for securely holding the gripping means 120 of the ESL 100. The receiving means 20 on the shelf edge rail 10 may also be a protruding hook-like element, adapted to receive the protruding element of the ESL 100. The receiving means 20 may also be a combination of at least one recess and at least one protruding element.

Figure 5A:
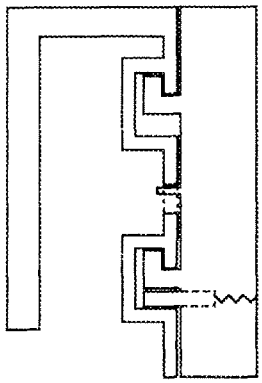
FIGS. 5*a* and 5*b* illustrate embodiments of the present invention wherein the gripping means and the receiving means are directed to minimize collection of dust and other particles.
Figure 5B:
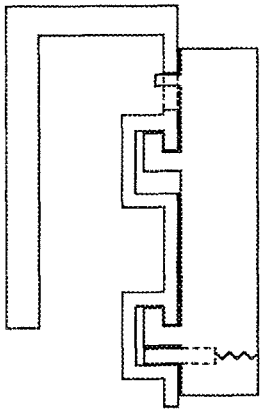

In another embodiment of the present invention, illustrated in FIGS. 5*a*-5*b*, the gripping means 120 of the ESL 100 is hook-like with the hook pointing upwards, and the receiving means 20 on the shelf edge rail 10, which is adapted to receive the gripping means 120, is shaped to be able to hold the ESL 100. In this embodiment, dust and other dust-like particles do not get trapped inside the gripping means 120. In addition, the gripping means 120 is easy to clean, and dust may even fall out of the gripping means 120 by gravitational forces.

Figure 5C:
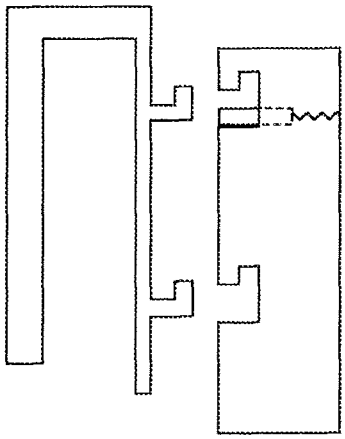
FIG. 5*c* illustrates an embodiment of the present invention wherein the gripping means of the ESL is formed as a recess, and the receiving means on the shelf edge rail is a protruding hook-like element.

In an embodiment of the present invention, referring to FIG. 5*c*, the gripping means is formed as a recess in the ESL 100, and the receiving means 20 on the shelf edge rail 10 is a protruding hook-like element. In this embodiment, the spring loaded locking element 160 is arranged inside the recess.

Figure 5D:
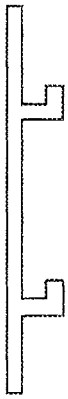
FIG. 5*d* illustrates an ESL holder having a substantially flat backside surface.

FIG. 5*d* illustrates an ESL holder 10, 400, 410 having a substantially flat backside surface. Thus, this ESL holder 10, 400, 410 can be directly attached to a wall, a container, cardboard box, or any other surface onto which it can be attached using fastening means (for example glue).

In an embodiment of the present invention, the at least one recess is an elongated recess extending in the longitudinal direction of the shelf edge rail 10, having a generally "L"-shaped cross-section. The leg of the "L" extends substantially perpendicular to the surface of the shelf edge rail 10, and the foot of the "L" extends substantially perpendicular to the leg inside the shelf edge rail 10. The length and width of the leg and the foot of the "L" in the ESL 100 and the shelf rail edge 10 can be varied as long as the gripping means 120 of the ESL 100 is adapted to match the receiving means 20 of the shelf edge rail 10.

Figure 6A:
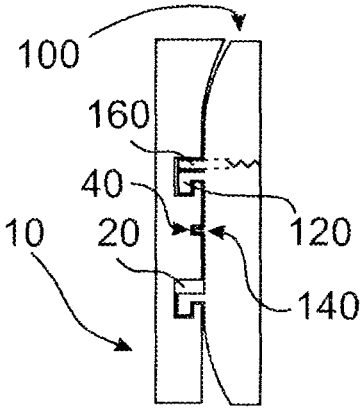
FIG. 6*a* illustrates an ESL locked to an ESL holder.
Figure 6D:
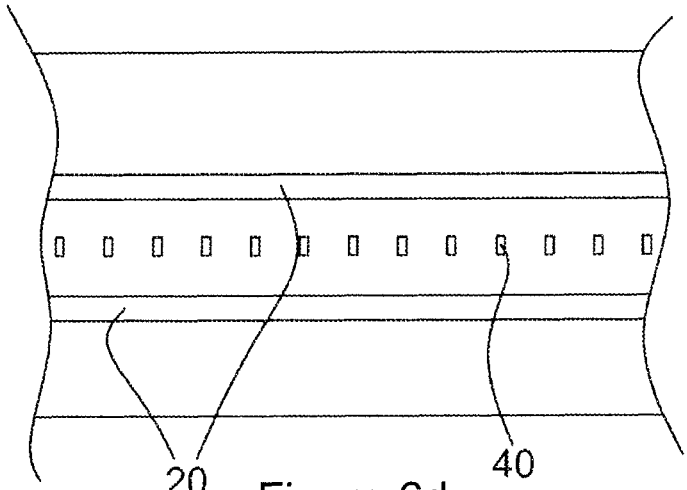
FIG. 6*d* illustrates a longitudinally extending shelf edge rail.

In an embodiment of the present invention, illustrated in FIGS. 6*a* and 6*d*, the shelf edge rail 10 comprises at least two recesses adapted to receive the ESL 100. The recesses have an "L"-shaped cross-section, and are adapted to receive the hook-like gripping means 120 on the ESL 100. The retractable and spring loaded locking element 160 is arranged adjacent to one of the gripping means 120 on the ESL 100, and enters the recess of the shelf edge rail 10 upon locking.

In another embodiment of the present invention, the shelf edge rail 10 is subdivided in sections, and thus the receiving means 20 is not continuous along the shelf edge rail 10. Each section of the shelf edge rail 10 may be adapted to comprise one or a plurality of ESLs 100.

Figure 6B:
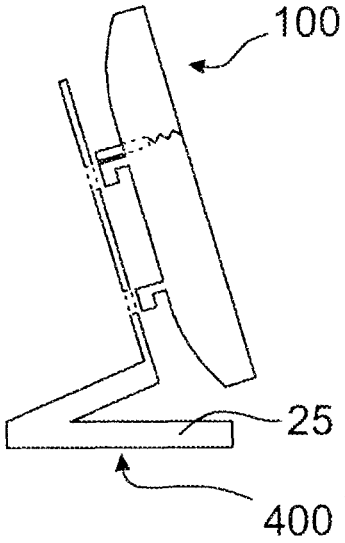
FIG. 6*b* illustrates a side view of one example of a free-standing ESL holder.
Figure 6C:
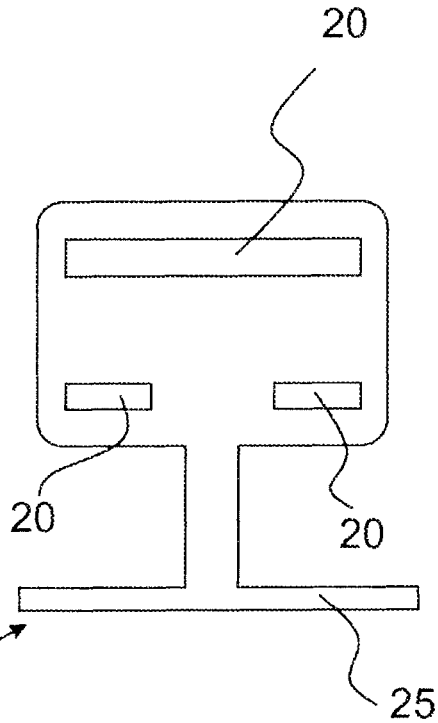
FIG. 6*c* illustrates a front view of the free-standing ESL holder.
Figure 7A:
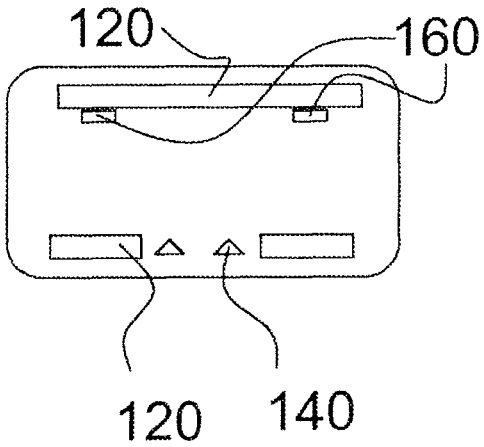
FIG. 7*a* illustrates an ESL adapted for a plate-like ESL holder.
Figure 7B:
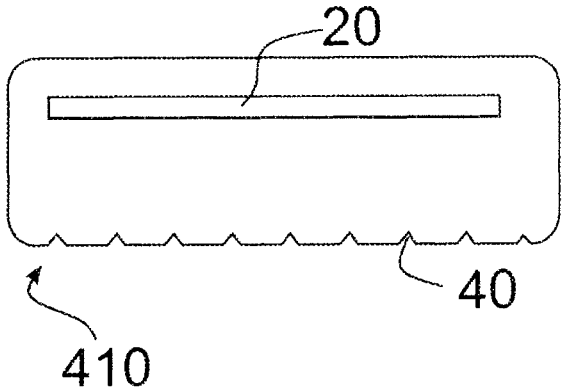
FIG. 7*b* illustrates a plate-like ESL holder.
Figure 8A:
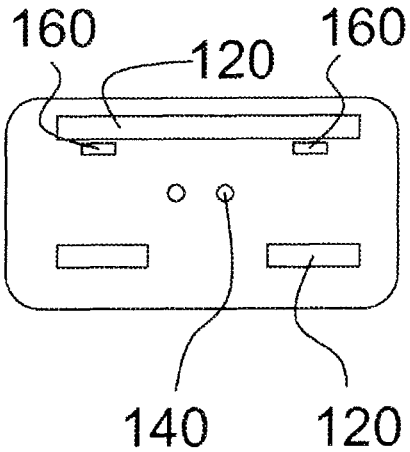
FIG. 8*a* illustrates an ESL adapted for a plate-like ESL holder.
Figure 8B:
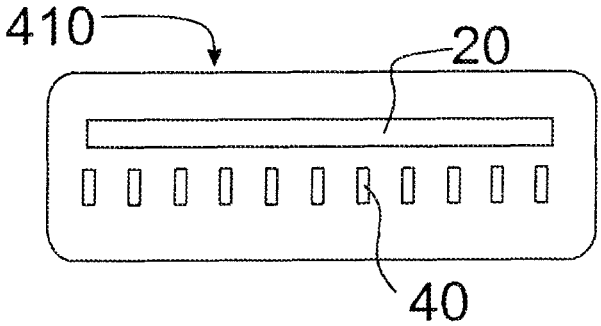
FIG. 8*b* illustrates a plate-like ESL holder.
Figure 8C:
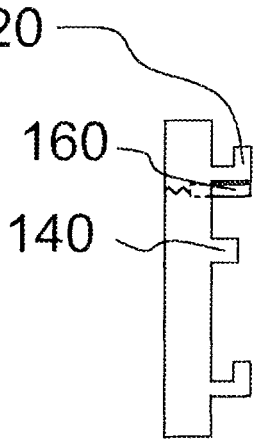
FIG. 8*c* shows a side view of the simple ESL of FIG. 8*a;*
Figure 8D:
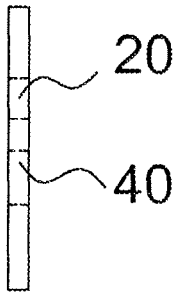
FIG. 8*d* shows a side view of the simple plate like ESL holder of FIG. 8*b;*

In another embodiment of the present invention, the ESL holder 400 is a free-standing holder 400 illustrated in FIGS. 6*b* and 6*c*. The free-standing holder 400 comprises an ESL 100 attachment surface with receiving means 20, where the attachment surface is mounted to at least one foot 25, which supports the free-standing holder 400 and makes it self-supported on a substantially flat surface. The free-standing holder 400 may also be placed on sloped surfaces (for example if glued), such that it is secured in a fixed position. The foot 25 may also function as a wall-mount, if angled differently with respect to the part of the free-standing holder 400 where the ESL 100 is attached. The free-standing holder can be made of a plastic material, a composite, or a metal, although it is not restricted to those materials.

Referring to FIG. 6*d*, there is no specified length of the shelf rail edge 10. The shelf rail edge 10 can be longitudinally extending and adapted to fit onto a shelf edge of any length. The ends of the shelf rail edge 10 may be open, or closed. The longitudinally extending shelf rail edge may also comprise positioning element slots 40 adapted to receive positioning elements 140 of the ESL 100. The positioning element secures the ESL 100 to a specific position on the shelf edge rail 10 and prevents the ESL 100 from being slid sidewise.

In yet another embodiment of the present invention, as shown in FIGS. 7*a*-7*b* and 8*a*-8*b*, the ESL holder 410 includes a plate-like holder 410 comprising at least one receiving means 20 adapted to receive the gripping means 120 of the ESL 100. The plate-like holder 410 can be made of plastic, composite, a metallic material, or the like. The plate-like holder 410 comprises slots 40 for receiving a positioning element 140 of the ESL 100, and securing the ESL 100 at a substantially fixed position. The plate-like holder 410 can be placed onto a shelf edge rail 10, or it may be attached directly to a shelf edge or the like. It is to be understood by a person skilled in the art that the plate-like holder 410 is very flexible, and may be used in a wide range of labeling applications without leaving the scope of the embodiments of the present invention. The receiving means 20 on the plate-like holder 410 is adapted to mate with the gripping means on the ESL 100. The plate-like holder 410 can also be attached to an object, for example merchandise, or attached to, for example, a wall using fastening means. The ESL 100 may be directly attached to virtually anything, as long as receiving means 20 are provided. Thus, the ESL 100 may be attached directly onto a box (for example, a cardboard box), as long as the receiving means is formed onto the box. The receiving means 20 on the plate-like holder 410 can be a slot.

In an alternative embodiment of the present invention, the ESL 100 and ESL holder 10, 400, 410 combination comprising a locking mechanism for releasably securing the ESL 100 to the ESL holder 10, 400, 410, has a mounting member that comprises a substantially flat ESL 100 attachment surface. This could be a rail or a holder of any of the types disclosed herein. The ESL 100 has locking elements 160 for securing it against the substantially flat mounting surface of the mounting member. The mounting member has receiving slots provided in the substantially flat ESL 100 attachment surface for receiving the locking elements 160. Furthermore, the locking elements 160 comprise a first spring-loaded and retractable member insertable in a respective slot, and a second fixed member having a hook-like shape insertable in a respective slot and enabling positioning of the fixed member in a hooked position from which it cannot be retracted. The relative position of the slots are such that, during insertion of the fixed member in its respective slot, the retractable member is located above or below its respective slot and thus is not insertable therein. When the fixed member has been brought into its hooked-on position, the retractable member snaps into its respective slot.

A person skilled in the art will realize that the inverted solution, that is, letting the locking mechanism and/or the gripping means be part of the ESL holder 10, 400, 410, and letting the ESL 100 comprise the receiving means 20, may be considered to fall within the scope of the embodiments of the present invention.

While the embodiments of the present invention have been described in connection with what is presently considered to be the most practical and preferred embodiments, it is to be understood that the invention is not to be limited to the disclosed embodiments. On the contrary, it is intended to cover various modifications and equivalent arrangements within the scope of the claims.

The invention claimed is:

1. A combination ESL and ESL holder with a locking mechanism for releasably securing the ESL to the ESL holder, comprising:

at least one gripping means provided on the ESL for cooperative engagement with the ESL holder;

a spring loaded locking element on the ESL, movable between at least a first protruding position and a second retracted position for cooperative engagement with the ESL holder;

at least one receiving means provided on the ESL holder for receiving the at least one gripping means and the spring loaded locking element in cooperative engagement, wherein the gripping means comprises a hook-like shape suitable for securely grasping the receiving means, wherein the spring loaded locking element is arranged and positioned on the ESL such that the spring loaded locking element cannot enter the receiving means on the ESL holder during insertion of the gripping means into the receiving means, and the spring loaded locking element is arranged and positioned such that the spring loaded locking element enters the receiving means by spring action when the gripping means is brought into a hooked position in the receiving means, and wherein the spring loaded locking element prevents removal of the ESL from the ESL holder unless the spring loaded locking element is retracted from its protruding position in locking engagement with the receiving means and thereby allows for the gripping means to leave its hooked position.

2. The combination ESL and ESL holder according to claim 1, further comprising at least one receiving element adapted to receive at least one protruding element of the locking mechanism or ESL.

3. The combination ESL and ESL holder according to claim 1, wherein the ESL holder comprises a positioning element slot adapted to receive a positioning element to secure the ESL sideways in relation to the ESL holder.

4. The combination ESL and ESL holder according to claim 2, wherein the ESL holder is a shelf edge rail that is longitudinally extended and adapted to receive the at least one protruding element of the locking mechanism or ESL.

5. The combination ESL and ESL holder according to claim 2, wherein the at least one receiving element is a protruding hook-like element adapted to receive the at least one protruding element of the locking mechanism or ESL.

6. The combination ESL and ESL holder according to claim 2, wherein the ESL holder is a shelf edge rail and the at least one receiving element is a recess that is adapted to receive the at least one protruding element of the locking mechanism or ESL.

7. The combination ESL and ESL holder according to claim 6, wherein the recess is an elongated recess extending in the longitudinal direction of the shelf edge rail, and the recess has a substantially "L"-shaped cross-section wherein a leg of the "L" extends substantially perpendicular to a surface of the shelf edge rail, and wherein a foot of the "L" extends substantially perpendicular to the leg of the "L" inside the shelf edge rail.

8. A locking mechanism for releasably securing a ESL to a ESL holder in a combination ESL and ESL holder comprising:

at least one gripping means provided on the ESL for cooperative engagement with a receiving means on the ESL holder;

a spring loaded locking element, movable between at least a first protruding position and a second retracted position, arranged on the ESL for cooperative engagement with a receiving means on the ESL holder, wherein the gripping means has a hook-shaped cross-section and is adapted to hook into the receiving means on the ESL holder, and wherein the spring loaded locking element is arranged on the ESL such that it abuts the ESL holder and is forced inwards into a recess of the ESL counteracting a spring force during insertion of the gripping means into the receiving means, and such that the spring loaded locking element snaps into the receiving means by spring action when the gripping means is positioned in a hooked position in the receiving means.

9. The locking mechanism according to claim 8, further comprising a magnetic element attached to the spring loaded locking element.

10. The locking mechanism according to claim 8, wherein the locking mechanism is integral with the ESL.

11. The locking mechanism according to claim 8, further comprising a positioning element provided on the ESL to secure the ESL sideways in relation to the ESL holder.

12. The locking mechanism according to claim 11, wherein the positioning element and the locking element are the same element.

13. The locking mechanism according to claim 9, wherein the spring loaded locking element further comprises a resilient member comprising at least one movable section and being attached to the ESL, and wherein the magnetic element is disposed on the at least one movable section of the resilient member.

14. The locking mechanism according to claim 9, wherein the magnetic element forces the spring loaded locking element from a locked position to an unlocked position when exposed to a magnetic field, enabling removal of the ESL from the ESL holder.

15. The locking mechanism according to claim 13, wherein the resilient member is a resilient tongue element comprising at least one free movable section, wherein the resilient tongue element is attached to the ESL, and wherein the magnetic element is attached to the at least one free movable section.

16. A combination ESL and ESL holder with a locking mechanism for releasably securing the ESL to the ESL holder, comprising:

a mounting member comprising a substantially flat ESL attachment surface;

a plurality of locking elements on the ESL for securing the ESL against the substantially flat attachment surface of the mounting member, wherein the mounting member comprises receiving slots provided in the substantially flat ESL attachment surface for receiving the locking elements, wherein the locking elements comprise a spring-loaded and retractable member insertable in a respective slot, and a fixed member having a hook-like shape insertable in a respective slot, and wherein the locking elements enable positioning of the fixed member in a hooked position from which it cannot be retracted, wherein the relative position of the receiving slots are such that, during insertion of the fixed member in its respective slot, the spring-loaded and retractable member is located above or below its respective slot and thus is not insertable therein, and wherein when the fixed member has been brought into a hooked-on position, the retractable member snaps into a respective slot.

* * * * *